US006304177B1

(12) United States Patent
Nigro, Jr. et al.

(10) Patent No.: US 6,304,177 B1
(45) Date of Patent: Oct. 16, 2001

(54) SWITCHING ASSEMBLY FOR AN EXIT ALARM LOCK

(75) Inventors: Daniel N. Nigro, Jr., Ocean Springs, MS (US); William P. Dye; Eugene Karl Siller, both of Indianapolis, IN (US)

(73) Assignee: Von Duprin, Inc., Indianapolis, IN (US)

( * ) Notice: Subject to any disclaimer, the term of this patent is extended or adjusted under 35 U.S.C. 154(b) by 0 days.

(21) Appl. No.: 09/566,097

(22) Filed: May 5, 2000

Related U.S. Application Data

(60) Provisional application No. 60/133,027, filed on May 7, 1999.

(51) Int. Cl.[7] ..... E05B 45/06

(52) U.S. Cl. ..... 340/542; 340/545.1; 340/545.2; 340/547; 200/61.67; 200/61.68; 200/50 B; 335/205; 335/207

(58) Field of Search ..... 340/542, 545.1, 340/545.2, 547; 200/61.67, 61.68, 50 B; 335/205, 207

(56) References Cited

U.S. PATENT DOCUMENTS

| | | | | |
|---|---|---|---|---|
| 4,123,752 | * | 10/1978 | Novotny | 340/545 |
| 5,065,136 | * | 11/1991 | Frolov et al. | 340/545 |
| 5,311,168 | * | 5/1994 | Pease, Jr. et al. | 340/542 |
| 5,448,027 | * | 9/1995 | Hoffman et al. | 200/50 B |
| 5,479,151 | * | 12/1995 | Lavelle et al. | 340/542 |
| 5,801,625 | * | 9/1998 | Wang | 340/506 |
| 5,925,861 | * | 7/1999 | Fromberg | 200/61.67 |

* cited by examiner

*Primary Examiner*—Daniel J. Wu
*Assistant Examiner*—Tai T. Nguyen
(74) *Attorney, Agent, or Firm*—Michael Best & Friedrich LLP

(57) ABSTRACT

A switching assembly for use with an exit alarm lock. The switching assembly uses two reed switches which must both be closed for the alarm horn to sound. An arm/disarm switch is operated by a magnet on a pivotable switch link which is operated by a link boss on rotatable deadbolt cams which are operated by the key cylinders. An alarm switch is operated by a magnet in the deadbolt.

13 Claims, 13 Drawing Sheets

FIG. 9

Table 1

Condition Table to be used with FIGS. 5A-5G and FIGS. 6A-6G

| Condition | Figure | Cam Position (inside cam) | First reed switch (27) | Second reed switch (29) | Deadbolt |
|---|---|---|---|---|---|
| Unauthorized exit/panic mode | | | | | |
| Armed | 5A | 0° | Closed | Open | Extended |
| Alarm | 5C | 0° | Closed | Closed | Retracted |
| Armed | 5G | CW 360° | Closed | Open | Extended |
| Authorized exit/entry mode | | | | | |
| Armed | 6A | 0° | Closed | Open | Extended |
| | 6B | CCW 90° | Open | Open | Extended |
| | 6D | CCW 270° | Open | Closed | In Transition |
| Disarmed | 6E | CCW 360° | Open | Closed | Retracted |
| | 6F | CW 270° | Open | Closed | Retracted |
| | 6G | CW 90° | Open | Open | In Transition |
| Armed | 6H | CW 0° | Closed | Open | Extended |

SWITCHING ASSEMBLY FOR AN EXIT ALARM LOCK

This application claims the benefit under 35 U.S.C. §119 (e) of the U.S. provisional application no. 60/133,027, filed May 7, 1999.

BACKGROUND OF THE INVENTION

This invention relates generally to exit devices and more particularly to alarm circuits for use with exit alarm devices.

An exit alarm lock is a door lock assembly that sounds an audible horn or alarm at the push-activated release of the locking element. These products are often used on the back doors of retail establishments such as restaurants and strip malls as a deterrent to unauthorized egress through the doors upon which the devices are installed. Their use is typically provoked by a security event such as internal losses by employees or customers. An exit alarm lock can be operated in two different modes: authorized exit/entry and unauthorized/panic exit. The authorized user, such as a store manager, owns a compatible key to the builders interior hardware installed on the exit alarm lock and is therefore able to arm or disarm the lock at his discretion. An unauthorized user does not own a key to the lock and is therefore not able to determine or alter the lock alarm state. However, this person can depress the pushpad for egress. In addition to this interior control, the lock is compatible with an exterior cylinder which affords an authorized user the ability to arm/disarm the lock from the outside.

These interface constraints require that the design of the exit lock and electronics be able to differentiate between the arm, disarm, and alarm states reliably over the life of the product. In current designs, these state transitions are handled adequately, but with significant shortcomings in the lock durability and end-user feedback. Some prior art exit alarm locks generate a misleading alarm sound while arming or disarming the lock. Further, some prior art devices are not able to allow switch link to pass through the same motion while being re-armed, so the link boss must "snap" the switch temporarily to an unarmed state before resting in an armed state. This temporary switch state change creates a higher resistance load to the end user rotating the key and can therefore create confusion or even concern of possible damage in the mind of the end user.

The foregoing illustrates limitations known to exist in present alarm switching assemblies for exit alarm locks. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a switching assembly for use with an exit device having an alarm circuit, the alarm circuit having an enabled condition and a disabled condition, and a horn, the horn having an on and an off condition, the switching assembly comprising: a first switch means for switching the alarm circuit between the enabled condition and the disabled condition; and a second switch means for switching the horn on and off, when the alarm circuit is in the enable condition.

The foregoing and other aspects will become apparent from the following detailed description of the invention when considered in conjunction with the accompanying drawing figures.

BRIEF DESCRIPTION OF THE DRAWING FIGURES

FIG. 9 is a condition table to be used with FIGS. 5A through 5G and FIGS. 6A through 6H.

DETAILED DESCRIPTION

Figure 1:
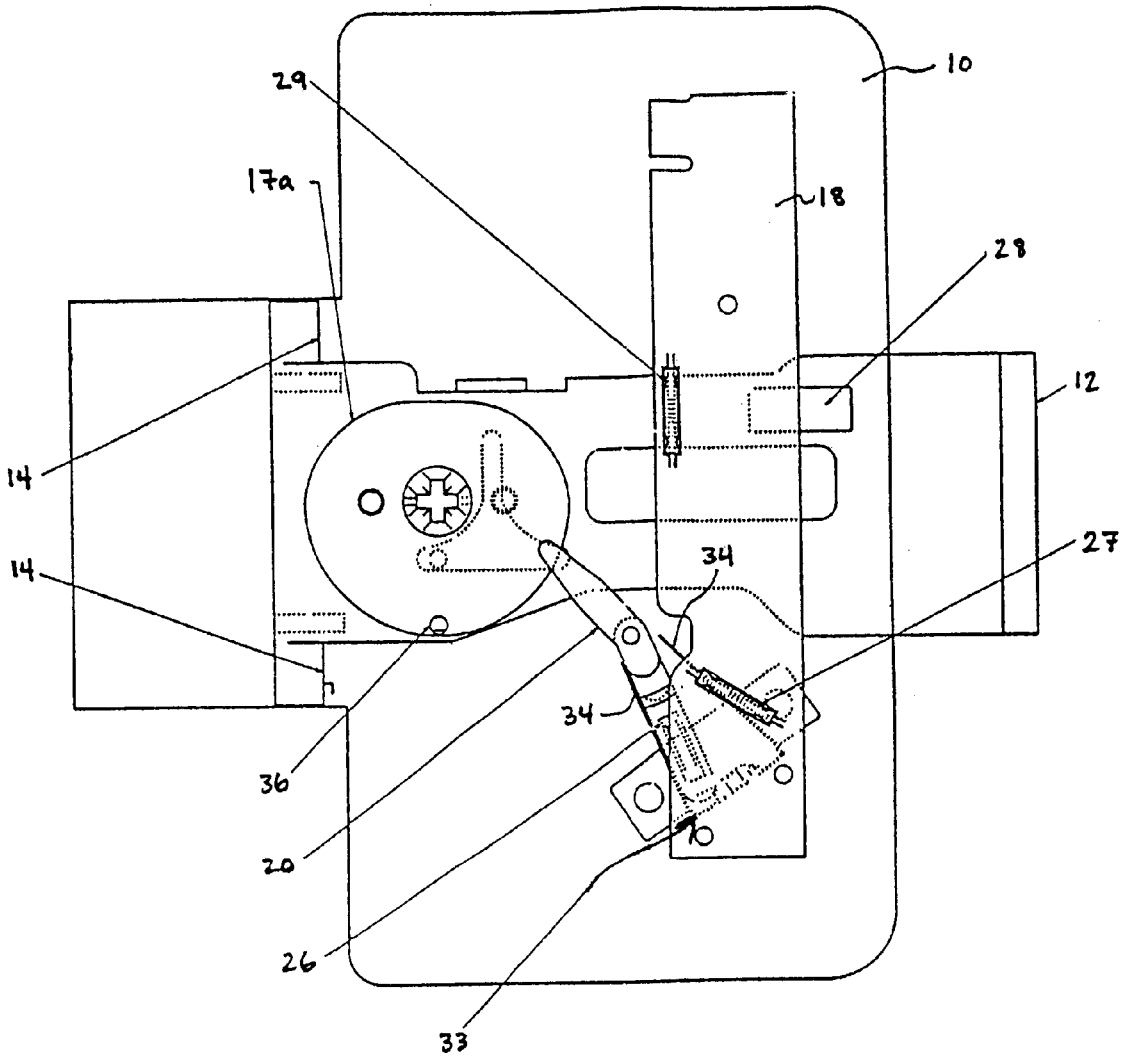
FIG. 1 is a top view of a lock assembly for use with an exit alarm lock, with components of the lock assembly removed for clarity.
Figure 2:
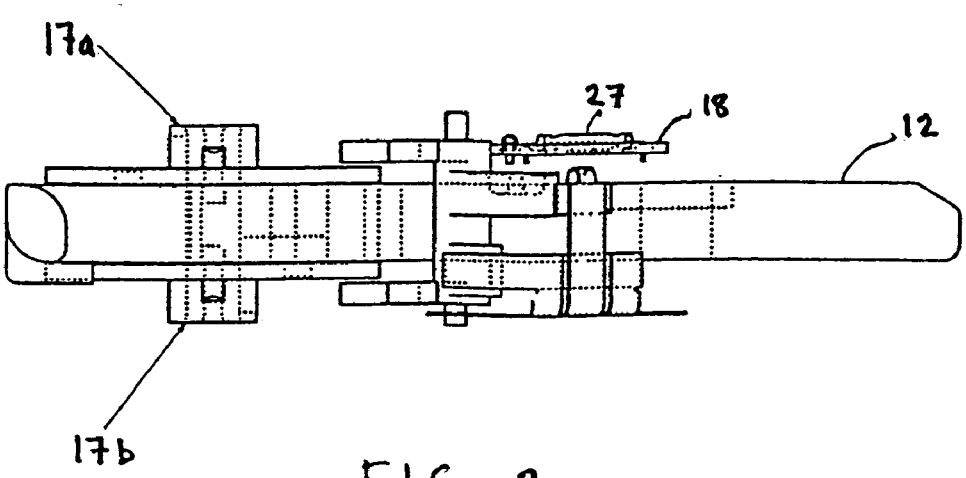
FIG. 2 is a side view of the lock assembly shown in FIG. 1.
Figure 3:
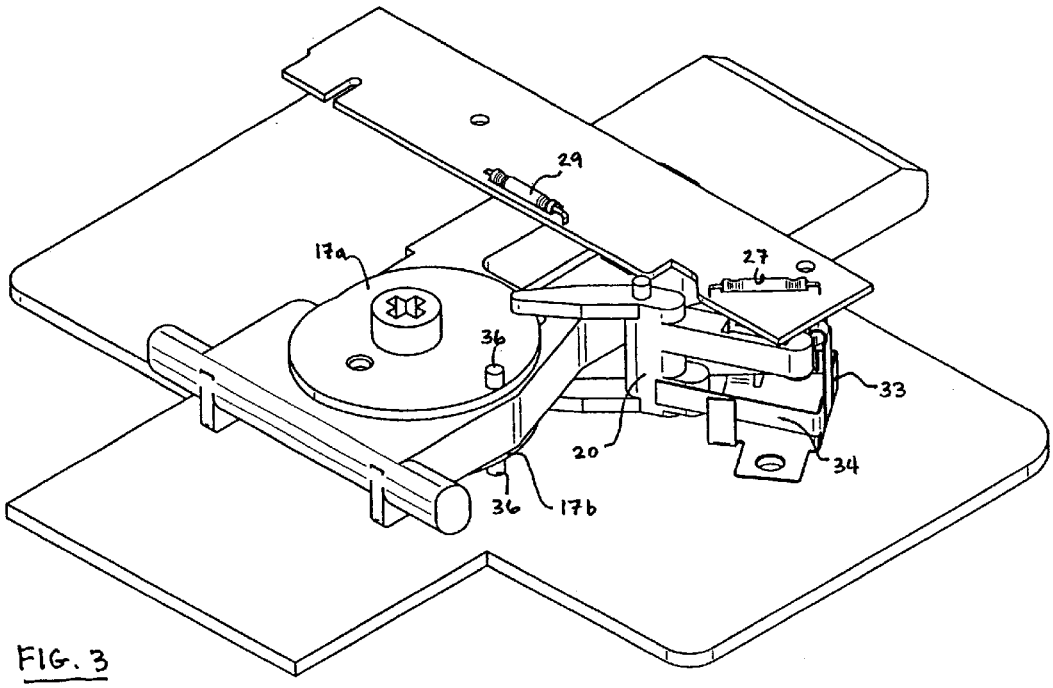
FIG. 3 is a perspective view of the lock assembly shown in FIG. 1 illustrating a switch link.

FIGS. 1 through 3 illustrate an alarm switching assembly for use with an exit alarm lock, such as that described in provisional patent applications no. 60/133,007, 134,013 and 60/134,014, the disclosures of which are hereby incorporated by reference.

Figure 5A:
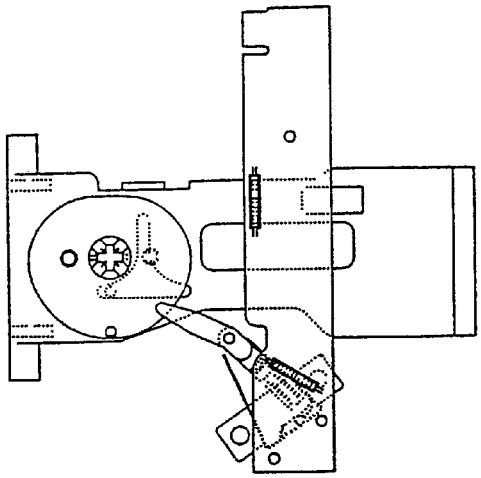
FIGS. 5A through 5G are top views of the lock assembly shown in FIG. 1, illustrating the operation of the lock assembly during pushpad depression and rearming of the alarm.
Figure 5B:
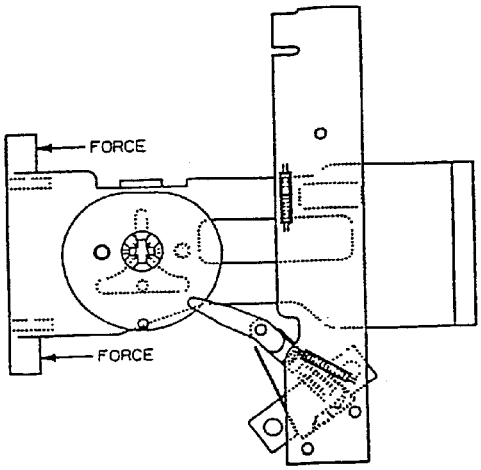
Figure 5C:
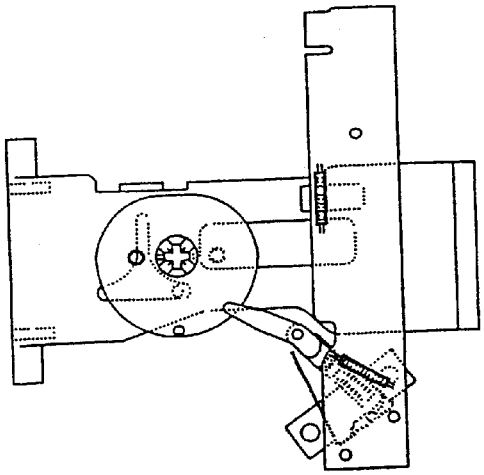
Figure 5D:
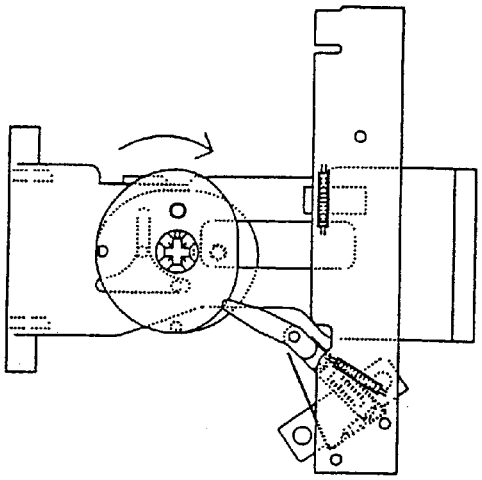
Figure 5E:
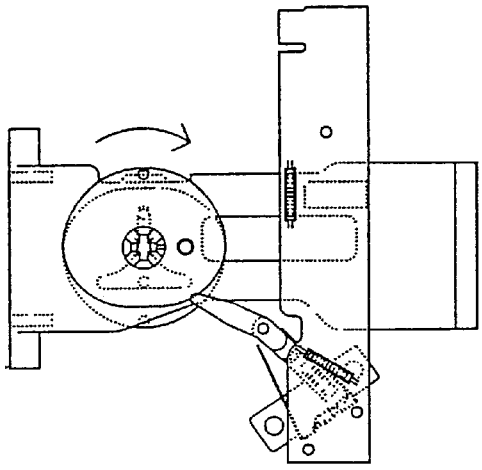
Figure 5F:
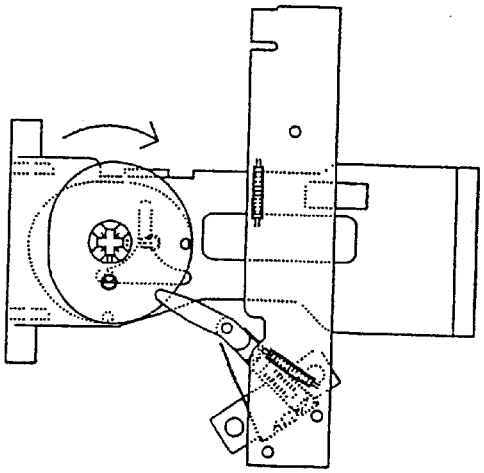
Figure 5G:
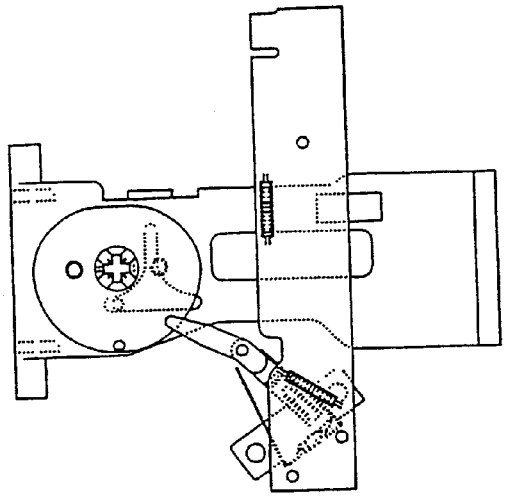

The exit alarm lock includes a base plate 10 which has a slidable deadbolt 12 mounted thereon. The deadbolt 12 includes two shoulders/bellcrank inputs 14 where a bellcrank (not shown) operates on the deadbolt 12 to retract the deadbolt from an extended position, shown in FIG. 1, to a retracted position, shown in FIG. 5C, when a pushpad (not shown) is depressed. The switching assembly includes two switch means (26, 27, 28, 29). The first switch means includes a first magnet 26 mounted on a magnet arm 21 of switch link 20 and a reed switch 27 attached to an alarm circuit board 18. The second switch means includes a second magnet 28 attached to the deadbolt 12 and a second reed switch 29, also attached to the alarm circuit board 18.

As the deadbolt 12 moves between the extended position and the retracted position, the second magnet 28 is moved into proximity with the second reed switch 29, closing the reed switch 29. If an alarm circuit is in an enabled (or armed) condition, the closing of reed switch 29 will sound a horn (not shown).

Figure 6A:
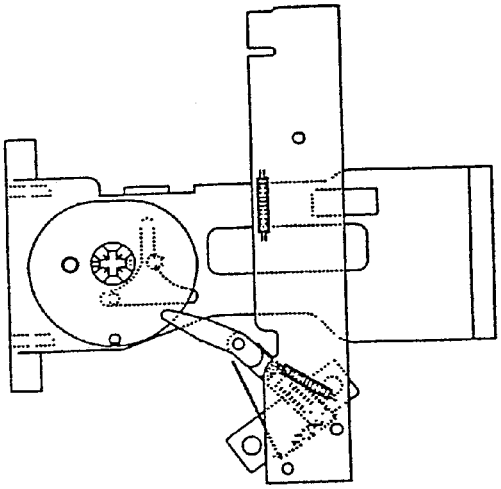
FIGS. 6A through 6H are top views of the lock assembly shown in FIG. 1, illustrating the operation of the deadbolt cams.
Figure 6B:
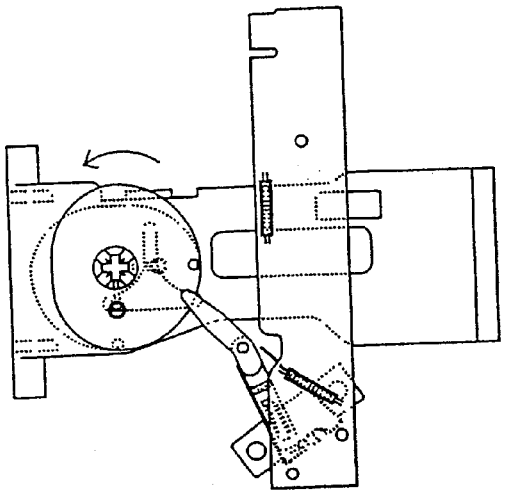

As the switch link 20, with first magnet 26 attached thereto, is moved between an unarmed (or disabled) position (as shown in FIG. 6B) to an armed (or enabled) position, first magnet 26 is moved into proximity with first reed switch 27, closing reed switch 27 and placing the alarm circuit into the enabled (or armed) condition.

Figure 4:
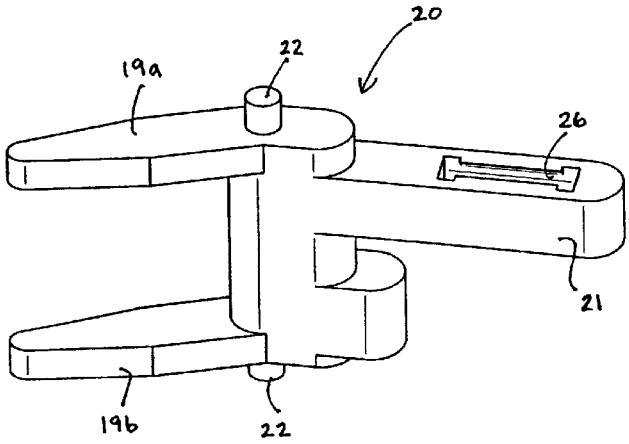
FIG. 4 is a perspective view of the switch link shown in FIG. 3.

As shown in FIG. 4, the switch link 20, consists of a central support 23 with pivots 22 extending from the ends of support 23. Pivots 22 engage mounting holes (not numbered) in circuit board 18 and base plate 10. Extending in a first direction from the central support 23 are two separated actuating arms 19*a*, 19*b*. Extending in a second direction, generally opposite to the first direction, is magnet arm 21. The free end of the magnet arm engages link spring 33, which acts as an overtravel spring to retain the switch link in its armed or unarmed positions.

Positioned above and below the deadbolt 12 are two cams, an inside deadbolt cam 17*a* and an outside deadbolt cam 17*b* (See FIG. 2). These cams 17*a*, 17*b* can be operated by key cylinders (not shown) to extend/retract deadbolt 12 and to arm/disarm the alarm circuit by moving the switch link 20 between the armed position and the disarmed position (as described below). Each cam 17*a*, 17*b* has a link boss 36 extending away from a face of the cam. Link boss 36 will engage an actuating arm 19*a*, 19*b* during selected portions of rotation of cams 17*a*, 17*b*.

The first mode of operation of the exit alarm lock to be described is an unauthorized/panic exit. This mode is defined as any time someone exits through the door by depressing the push pad without actuating the key cylinder, therefore creating an alarm condition. This could be either someone stealing merchandise or a panic exit situation. The exit alarm lock is in the enabled or armed condition where the switch link 20 is in the armed position (shown in FIG. 5A), first reed switch 27 is closed, the deadbolt 12 is extended and second reed switch 29 is open.

When someone exits in this mode, the push pad is depressed which causes deadbolt 12 to retract via the bellcrank operating on deadbolt shoulders 14. At this time the first magnet 26 in the switch link 20 is held in close proximity to first reed switch 27 by the link spring 33, keeping first reed switch 27 closed. The second magnet 28, being part of the deadbolt 12, moves closer to second reed switch 29 and causes it to close. Second magnet 28 is magnetized across its entire length so that as it passes under second reed switch 29, second reed switch will remain closed for the entire deadbolt retraction travel. After the push pad is fully depressed, the deadbolt 12 will be fully retracted. When both reed switches 27, 29 are closed, the alarm horn will sound (See FIGS. 5A through 5C).

To place the exit alarm lock back into the armed condition with the deadbolt 12 extended, an authorized user inserts a key into the key cylinder and rotates it 360° either clockwise or counterclockwise, depending upon the handing of the door and whether the inside or outside key cylinder is being used. The key cylinders (not shown) are connected to deadbolt cams 17*a*, 17*b*. Rotation of deadbolt cams 17*a*, 17*b* will fully extend deadbolt 12, moving second magnet 28 away from second reed switch 27, opening reed switch 27 and silencing the alarm horn (See FIGS. 5D through 5G). First reed switch 27 is never actuated during this condition. See Table 1 and FIGS. 5A through 5G.

The second mode of operation is authorized exit/entry. This mode is defined as any time someone exits or enters through the door by placing the exit alarm lock in a disarmed condition. The disarmed condition is accomplished by using the inside or outside key cylinder. The following describes the operation of the exit alarm lock as if someone is exiting through the door from the inside.

Figure 6C:
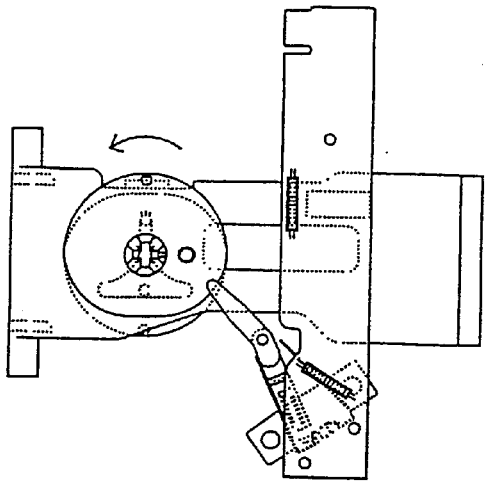
Figure 6D:
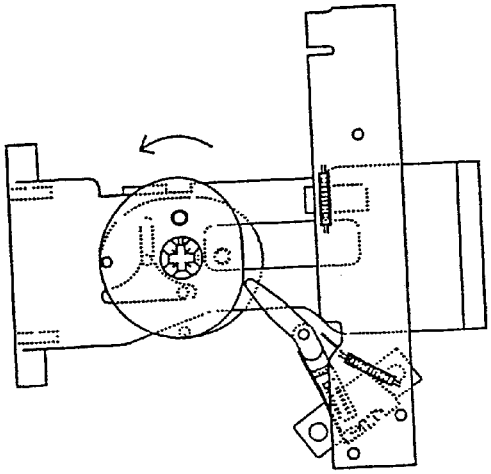
Figure 6E:
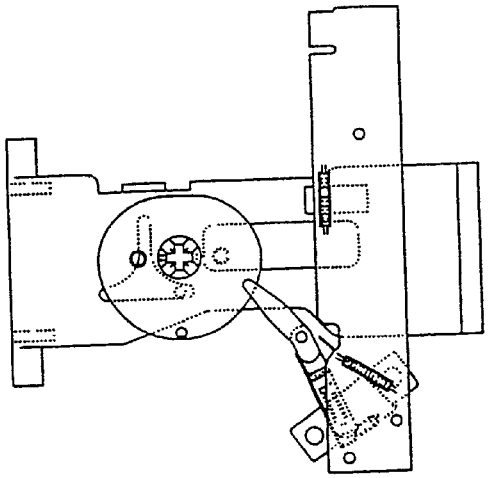

To do an authorized exit, the user inserts a key into the key cylinder and rotates it 360° counterclockwise. At the end of this rotation, the deadbolt 12 will be fully retracted, the door will be unlatched and the exit alarm lock will be in the disarmed condition. Using 0° as the initial starting point, during the first 90° of rotation (FIGS. 6A and 6B), the inside deadbolt cam 17*a* rotates the link boss 36 past the switch link 20 and causes the switch link 20 to move from a position that keeps first reed switch 27 closed (FIG. 6A) to a position that opens first reed switch 27 (FIG. 6B). Switch link 20 is held in this new position by link spring 33. Rotating the key to the 270° position (FIGS. 6C and 6D) retracts the deadbolt 12. Second reed switch 29 also closes during this action. Since first reed switch 27 is now open, no alarm will occur. The key is rotated to the 360° position (FIG. 6E) with no other action happening in the exit alarm lock. The key can now be removed if desired.

Figure 6F:
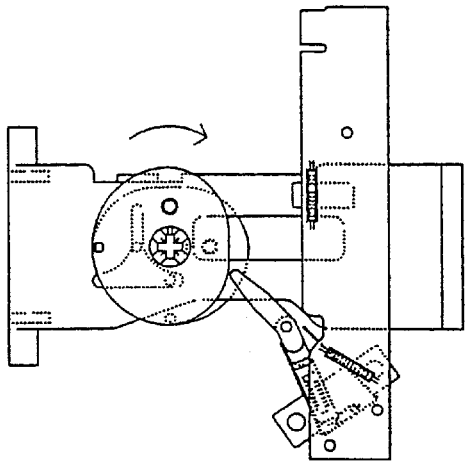
Figure 6G:
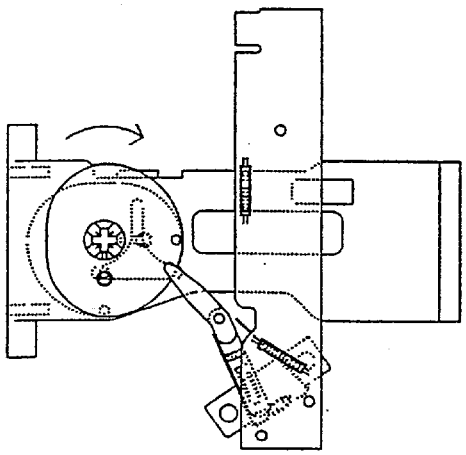
Figure 6H:
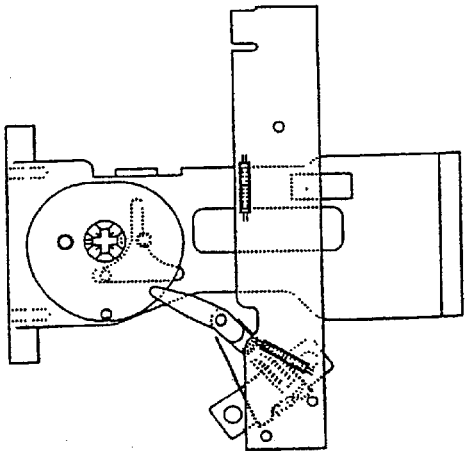

To get back to an armed condition, the user inserts the key and rotates it 360° clockwise (FIGS. 6F through 6H). The reverse of the above happens as the deadbolt 12 is fully extended and the exit alarm lock will be in the armed condition. See Table 1 and FIGS. 6A through 6H.

Figure 7A:
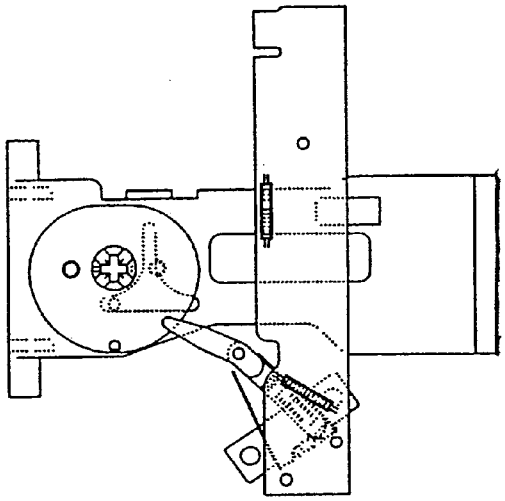
FIGS. 7A through 7G are top views of the lock assembly shown in FIG. 1, illustrating the operation of the lock assembly during overtravel.
Figure 7B:
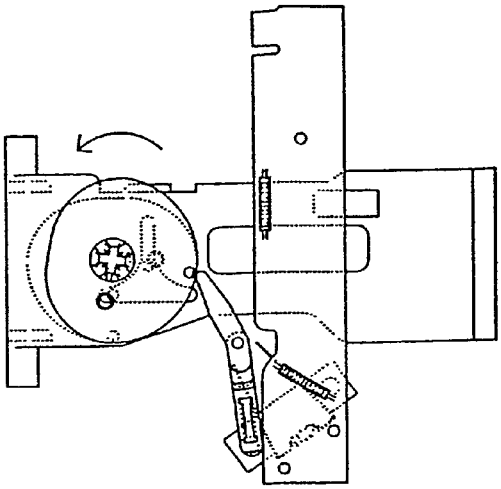
Figure 7C:
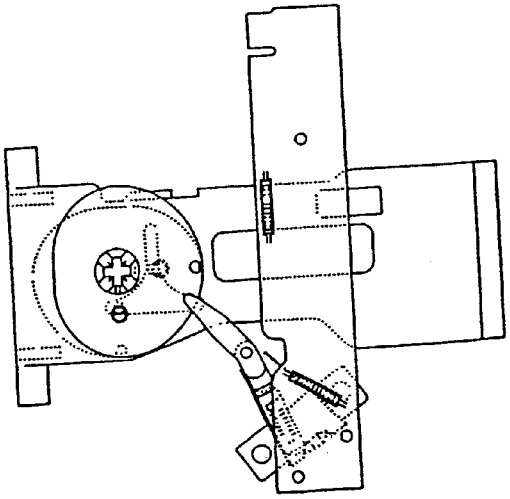
Figure 7D:
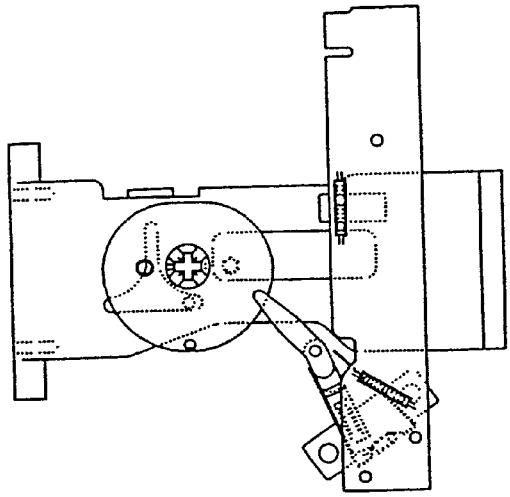
Figure 7E:
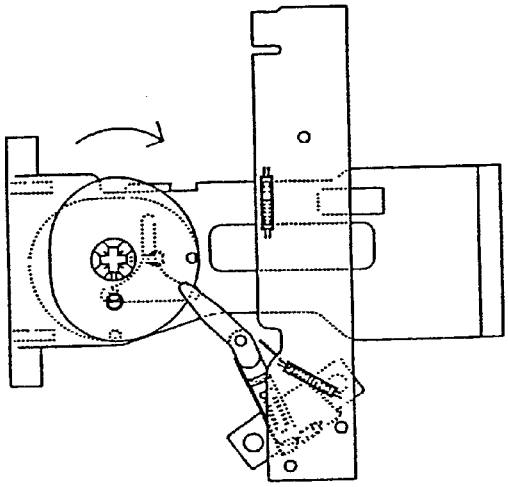
Figure 7F:
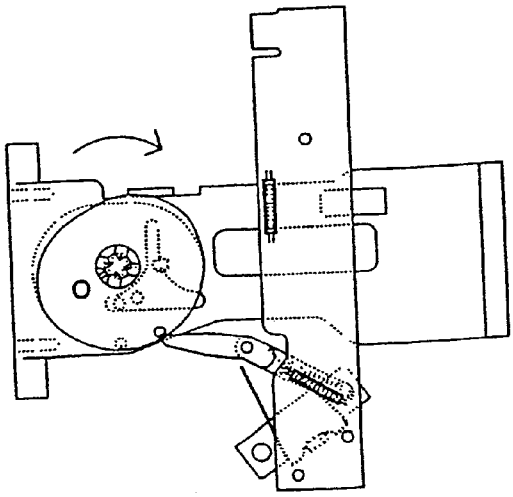
Figure 7G:
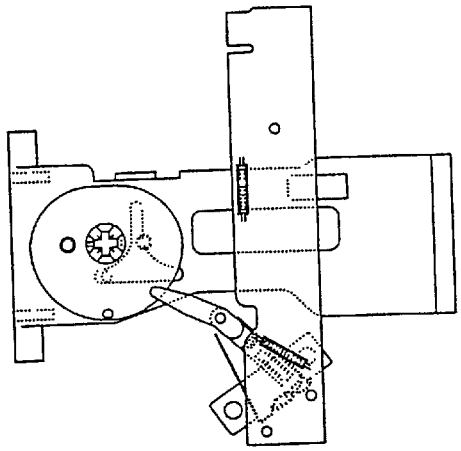
Figure 8A:
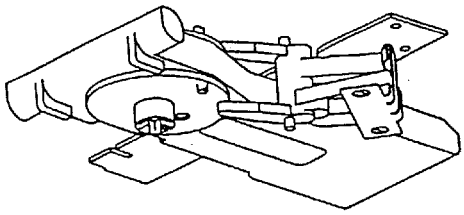
FIGS. 8A through 8K are bottom perspective views of the lock assembly shown in FIG. 1, illustrating the motion of the outside deadbolt cam in relation to the switch link with overtravel during an authorized disarm and rearm cycle.
Figure 8B:
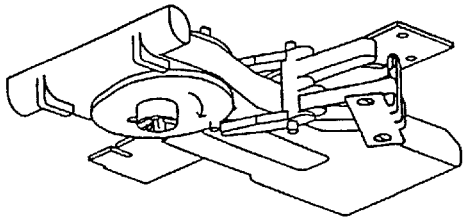
Figure 8C:
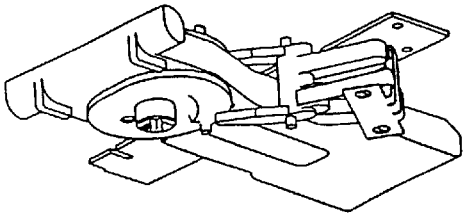
Figure 8D:
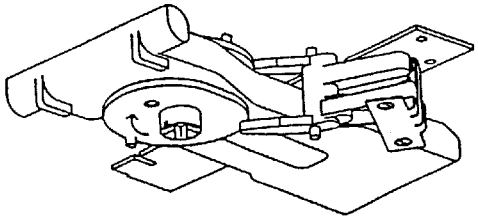
Figure 8E:
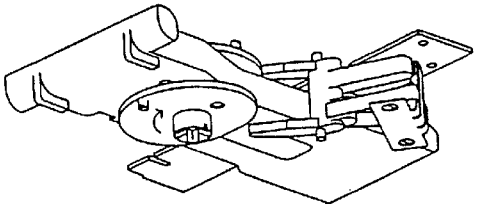
Figure 8F:
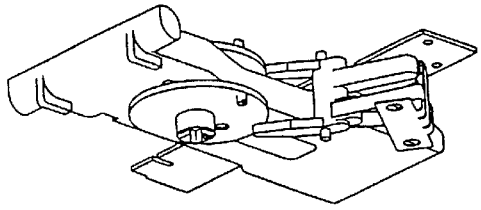
Figure 8G:
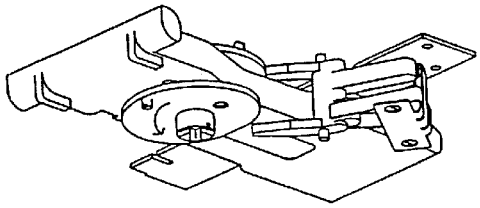
Figure 8H:
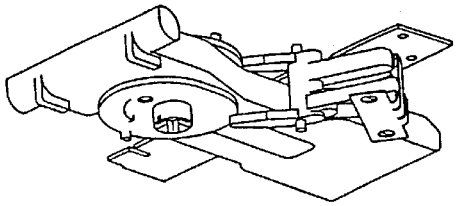
Figure 8I:
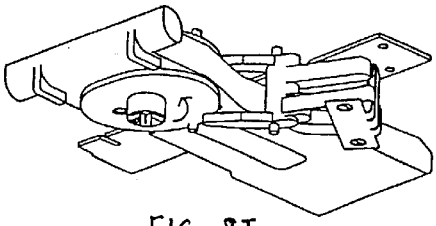
Figure 8J:
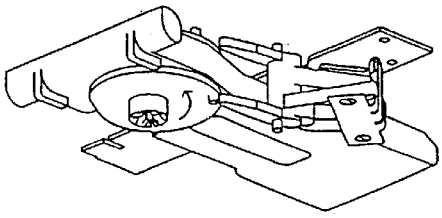
Figure 8K:
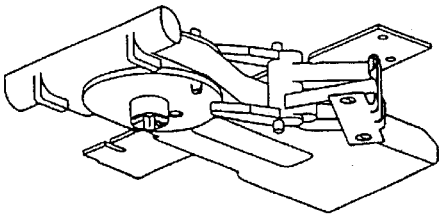

The next mode of operation is overtravel. In order for the switch link 20 to engage the link bosses 36, the switch link 20 must always be in the path of the link bosses 36. The switch link 20 must also be able to be actuated by the link bosses 36 from either direction, i.e., either a clockwise rotation or a counterclockwise rotation. Therefore as the link bosses 36 travel past the switch link 20, the switch link must have some degree of overtravel to allow the link boss 36 to pass but yet return to a position that will allow the link boss 36 to engage the switch link 20 when returning from the opposite direction. The link spring 33 has two overtravel leafs 34 that contact the switch link 20 during this condition. See FIGS. 7A through 7G to better illustrate this action during an authorized exit/entry sequence. In particular, FIGS. 7A and 7F show an overtravel condition and FIGS. 7C and 7G show the overtravel leafs 34 returning switch link 20 to its normal position (disarmed and armed respectively) after link boss 36 passes the switch link actuating arms 19*a*, 19*b*.

The exit alarm lock can be used with an inside and an outside key cylinder. These cylinders rotate their respective inside 17*a* and outside 17*b* deadbolt cams. Each link boss 36 on cams 17*a*, 17*b* is capable of contacting the switch link 20 in either of its two positions. This type of operation allows arming or disarming from either the inside or outside key cylinder in any sequence. The following authorized exit/entry scenarios can be accomplished with this mechanism:

- Disarm the exit alarm lock from the inside key cylinder, exit through the door and rearm the exit alarm lock from the outside key cylinder;
- Disarm the exit alarm lock from the outside key cylinder, enter through the door and rearm the exit alarm lock from the inside key cylinder;
- Disarm the exit alarm lock from the outside key cylinder, open the door and rearm the exit alarm lock from the outside key cylinder;
- Disarm the exit alarm lock from the inside key cylinder, open the door and rearm the exit alarm lock from the inside key cylinder;

FIGS. 8A through 8K illustrate the motion of the outside cam 17*b* in relation to the switch link 20 with overtravel during an authorized disarm (FIGS. 8A through 8F) and rearm cycle (FIGS. 8F through 8K).

The primary functions of the switching cycle in an exit alarm lock are as follows: to allow an authorized user the ability to arm or disarm the exit alarm lock from either the inside or outside key cylinder, to arm (position the lock elements such that a depression of the pushbar will force the lock into an alarmed condition), and, when in alarm mode, to allow an authorized user the ability to rearm (extend deadbolt and silence alarm) the lock.

Due to these multiple operational modes, the design integrity of the switching mechanism/electronics is critical to the end user's ability to properly operate the device. The present exit alarm lock switching design has three fundamental advantages over prior art devices.

The first advantage is in the present invention's ability to perform the transition from one state to another without any switch overlap or misleading user feedback. This is called the "timing", and can best be explained by reviewing the rotation of either the interior or exterior deadbolt cam 17*a*, 17*b*. When the lock is in an unarmed condition, first reed switch 27 is open and second reed switch 29 is closed (see Table 1). If the inside cam 17*a* is rotated clockwise, the motion between 90° and 270° will extend the deadbolt 12 thereby opening second reed switch 29. Second reed switch 29 will always be opened by 270°, regardless of assembly tolerance or part variations. Further rotation to 360° will result in the closing of first reed switch 27 which arms the device. Because first reed switch 27 is closed inside of this final 90° of rotation (from 270° to 360°, the device will never visit an alarm state (in which both first reed switch 27 and second reed switch 29 are closed) during the transition from an unarmed to an armed state. Nor will an alarm state be reached during the authorized disarm cycle either. When a device that is in the alarm mode is reset (rearmed), the alarm will disengage during the transition of deadbolt 12 as second reed switch 29 is opened. This advantage is significant in that it provides a consistent response to an authorized user without any misleading alarm sounding during rotation of either the interior or exterior cams 17*a*, 17*b*.

Secondly, the reliability of this switching design has advantages over prior art in the consistency of the switch link 20 travel between an armed and unarmed state. Because of the allowance of overtravel in this mechanism, the link boss 36 will reliably contact the same area of the switch link 20 whether the lock is being armed of rearmed after an alarm condition. One example of prior art is unable to allow the switch link to pass through the same motion while being rearmed as while be armed, so the link boss must "snap" the switch temporarily to an unarmed state before resting in an armed state. This temporary switch state creates a higher resistive load to the end user rotating the key and can therefore create confusion or even concern of possible damage in the mind of the user. The present invention allows consistently low forces during all transitions and a level of predictability for the end user. This example of prior art with higher forces can result in damage to the switching mechanism as well as premature failure of the switch, which sees double the cycle count for each rearm cycle.

Finally, the present invention is simple and cost-effective. An example of prior art uses electronic logic to determine the appropriate device state (unarmed, armed, or alarmed) as a method of timing over the mechanical method employed within the present invention. Because a certain degree of mechanical switching logic is inherently necessary, the practice of employing a complicated electronic logic sequence to determine the device state is not only less cost effective, but likely more prone to failure as many more components are required to allow this method to function. The alarm function in the present invention preferably utilizes sealed switches and requires both switches 27, 29 be closed in order for the alarm horn to sound. Sealed switches of this type are much more impervious to dirt, water, or other environmental factors than are push-button switches. The present invention is therefore less susceptible to environment-induced inability to enter the alarm mode than with the prior art. The link spring 33 provides not only the ability to hold the switch link 20 in either an armed or unarmed state but also the action required for switch link 20 overtravel during both the transition to an armed (or rearmed) state and to an unarmed state. This three-in-one ability of the link spring is unique and allows fewer total components to be employed than with prior designs which relied on more complicated mechanical or electronic switch timing.

Having described the invention, what is claimed is:

1. A switching assembly for use with an exit device having an alarm circuit and a deadbolt, the alarm circuit having an enabled condition and a disabled condition, and a horn, the horn having an on and an off condition, the deadbolt moveable between an extended position and a retraced position, the switching assembly comprising;

a first switch including a first magnet sensor, a first magnet, and a switch link having a pivot point and an actuating arm extending from the pivot point in a first direction and a magnet arm extending from the pivot point in a second direction, the first magnet being coupled to the magnet arm and being moveable relative to the first magnet sensor between a position closing the first switch and enabling the alarm circuit and a position opening the first switch and disabling the alarm circuit; and a second switch having a second magnet sensor and a second magnet coupled to the deadbolt and being moveable relative to the second magnet sensor, wherein the second magnet is closer to the second magnet sensor when the deadbolt is retracted than when the deadbolt is extended, thereby closing the second switch and switching on the horn when the deadbolt is retracted and the alarm circuit is enabled.

2. The switching assembly according to claim 1, wherein the first direction is different than the second direction.

3. The switching assembly according to claim 1, further composing a cam, which engages the switch link to move the switch link between a first position and a second position, the first position corresponding to the alarm enabled condition, the second position corresponding to the alarm disabled condition.

4. The switching assembly according to claim 3, wherein the cam is adapted to slidably move the deadbolt between its extended position and its retracted position.

5. The switching assembly according to claim 3, wherein the cam comprises a link boss and the link boss engages the actuating arm to move the switch link between the first position and the second position.

6. The switching assembly according to claim 1, further comprising a link retainer, which engages the switch link and holds the switch link in one of the first position or the second position.

7. The switching assembly according to claim 6, wherein the link retainer comprises an over-center spring.

8. A switching assembly for use with an exit device having an alarm circuit, the alarm circuit having an enabled condition and a disabled condition, and a horn, the horn having an on and an off condition, the switching assembly comprising:

a first switch means for switching the alarm circuit between the enabled condition and the disabled condition, the first switch means comprising a first magnet and a first magnet sensor;

a second switch means for switching the horn on and off, when the alarm circuit is in the enabled condition, the second switch means comprising a second magnet and a second magnet sensor;

a link means for switching the first switch means between the alarm enabled condition and the alarm disabled condition, the link means comprising a pivotable link pivoting about an axis and having upper and lower actuating arms extending in a first direction from the axis of pivot and having a magnet arm extending in a second direction from the axis of pivot, the magnet arm having the fist magnet thereon; and a deadbolt slidably moveable between an extended position and a retracted position, the second magnet being positioned on the deadbolt.

9. The switching assembly according to claim 8, wherein the magnet sensors are magnetic reed switches.

10. The switching assembly according to claim 8, wherein each magnet sensor has an open condition and a closed condition and both the first magnet sensor and the second magnet sensor must be in the closed condition for the horn to turn on.

11. The switching assembly according to claim 8, further comprising:

two cam means for moving the pivotable link between a first position and a second position, the first position corresponding to the alarm enabled condition, the second position corresponding to the alarm disabled condition.

12. The switching assembly according to claim 11, wherein the cam means comprise rotatable deadbolt cams, each cam having a link means operator thereon, each link means operators engaging a link actuator arm to move the pivotable link between the first position and the second position.

13. The switching assembly according to claim 8, further comprising a link means retainer for retaining the pivotable link in one of the first position or the second position.

* * * * *